US011725459B2

(12) United States Patent
Liu et al.

(10) Patent No.: US 11,725,459 B2
(45) Date of Patent: Aug. 15, 2023

(54) MULTIPLE RIDGE DIAMOND COMPACT FOR DRILL BIT AND DRILL BIT

(71) Applicant: KINGDREAM PUBLIC LIMITED COMPANY, Hubei (CN)

(72) Inventors: Qiang Liu, Hubei (CN); Guanfu Tu, Hubei (CN); Hong Xu, Hubei (CN)

(73) Assignee: KINGDREAM PUBLIC LIMITED COMPANY, Hubei (CN)

( * ) Notice: Subject to any disclaimer, the term of this patent is extended or adjusted under 35 U.S.C. 154(b) by 0 days.

(21) Appl. No.: 17/259,383

(22) PCT Filed: Jul. 10, 2019

(86) PCT No.: PCT/CN2019/095427
§ 371 (c)(1),
(2) Date: Jan. 11, 2021

(87) PCT Pub. No.: WO2020/011199
PCT Pub. Date: Jan. 16, 2020

(65) Prior Publication Data

US 2021/0277722 A1 Sep. 9, 2021

(30) Foreign Application Priority Data

Jul. 13, 2018 (CN) ..... 201810767637.1

(51) Int. Cl.
*E21B 10/567* (2006.01)

(52) U.S. Cl.
CPC ..... *E21B 10/5673* (2013.01)

(58) Field of Classification Search
CPC ..... E21B 10/5673; E21B 10/5676
See application file for complete search history.

(56) References Cited

U.S. PATENT DOCUMENTS 4,694,918 A * 9/1987 Hall ..... E21B 10/5673 51/293
5,054,246 A * 10/1991 Phaal ..... E21B 10/5673 51/307

(Continued)

FOREIGN PATENT DOCUMENTS

CN 106089089 * 11/2016
CN 106089089 A 11/2016

(Continued)

OTHER PUBLICATIONS

International Search Report received for PCT/CN2019/095427, dated Oct. 9, 2019.

(Continued)

*Primary Examiner* — Blake Michener
(74) *Attorney, Agent, or Firm* — Kilpatrick Townsend & Stockton LLP

(57) ABSTRACT

The disclosure relates to a multiple ridge diamond compact for a drill bit, comprising a hard alloy substrate (cemented carbide substrate) (102) and a diamond composite layer (101), wherein an end surface of the diamond composite layer is provided with at least two ridges angled relative to each other, and converging ends of two adjacent ridges extend to an edge of the diamond composite layer (101) so as to form a concave cutting edge portion on the edge. The plurality of ridges angled relative to each other are set as a cutting surface group to simultaneously cut a formation, the formation is first pre-crushed by means of the ridges angled relative to each other, the ridges first enter the formation from sharp surfaces (the converging ends of the ridges), a crushing pit in the direction of the ridges is further enlarged, and then the formation is further extruded and crushed by inclined surfaces on two sides of the group of ridges, such that the cutting surfaces thereof have a plowing effect, thus improving the crushing and drilling performance of the (Continued)

diamond compact, reducing the drilling cutting resistance, and further increasing the mechanical drilling speed (rate of penetration) of the diamond drill bit.

17 Claims, 3 Drawing Sheets

(56) References Cited

U.S. PATENT DOCUMENTS

| | | | | | |
|---|---|---|---|---|---|
| 5,172,778 | A | * | 12/1992 | Tibbitts | E21B 10/5673 175/420.1 |
| 5,173,090 | A | * | 12/1992 | Scott | E21B 10/5676 51/293 |
| 5,346,026 | A | * | 9/1994 | Pessier | E21B 10/5735 175/374 |
| 6,045,440 | A | * | 4/2000 | Johnson | E21B 10/5673 451/540 |
| 9,376,867 | B2 | * | 6/2016 | DiGiovanni | B24C 1/04 |
| D878,436 | S | * | 3/2020 | Dunaway | D15/139 |
| 2004/0149495 | A1 | * | 8/2004 | Thigpen | E21B 10/5673 175/426 |
| 2010/0059287 | A1 | * | 3/2010 | Durairajan | E21B 10/5673 175/420.2 |
| 2014/0182947 | A1 | * | 7/2014 | Bhatia | E21B 10/46 175/327 |
| 2018/0291689 | A1 | * | 10/2018 | Palmer | E21B 10/43 |
| 2019/0338599 | A1 | * | 11/2019 | Bellin | E21B 10/5673 |
| 2020/0347680 | A1 | * | 11/2020 | Tian | E21B 10/5673 |

FOREIGN PATENT DOCUMENTS

| | | | | |
|---|---|---|---|---|
| CN | 106089091 | A | | 11/2016 |
| CN | 206592075 | | * | 10/2017 |
| CN | 206592075 | U | | 10/2017 |
| CN | 207004435 | | * | 2/2018 |
| CN | 207004435 | U | | 2/2018 |
| CN | 108661565 | A | | 10/2018 |
| GB | 2424017 | A | | 9/2006 |
| WO | 2017/172431 | A2 | | 10/2017 |

OTHER PUBLICATIONS

Eurasian Patent Application No. 202190273, Official Notification dated Mar. 30, 2022, 2 pgs.

* cited by examiner

MULTIPLE RIDGE DIAMOND COMPACT FOR DRILL BIT AND DRILL BIT

CROSS REFERENCES TO RELATED APPLICATIONS

This application is a national stage of PCT/CN2019/095427 filed on Jul. 10, 2019, and is based on an application with a Chinese application number of 201810767637.1 and an application date of Jul. 13, 2018, and claims its priority. The content of the Chinese application is hereby incorporated into the present disclosure as a whole.

FIELD OF THE INVENTION

The present disclosure refers to a multiple ridge diamond compact for a drill bit and is related to the technical field of petroleum drilling.

BACKGROUND OF THE INVENTION

Since the 1980s, diamond drill bits have been widely used in oil and gas drilling projects. Diamond bits are substantially composed of a bit body and cutting elements. There are three categories of diamond bits according to the cutting elements: PDC (polycrystalline diamond compact) bits, TSP (thermally stable polycrystalline diamond) bits and natural diamond bits. PDC bits are mainly used for drilling in soft to medium-hard formations. After continuous technological development, PDC bits have a wider application range and have good economic value. TSP bits are mainly used for drilling in medium to very hard formations. At present, deep well operations in oil and gas drilling projects are gradually increasing, and formations to be encountered are becoming more and more complex.

In the case of drilling into gravel-bearing formation or formations staggered between soft and hard and changing frequently, the impact load on the diamond compact is relatively large, and the diamond compact is prone to tooth chipping and failure, resulting in overall failure of the drill bit. Therefore, the drilling site urgently needs a diamond compact with strong impact resistance. The impact resistance of the existing diamond compact is mainly improved by changing the interface structure of the diamond layer and the cemented carbide base in the diamond compact to reduce its residual stress, or changing the material formula and processing technology. There are also PCD layers with special-shaped teeth of such as a ball head shape and a cone shape. Although the PDC with this special-shaped structure improves its impact resistance, there are phenomena such as high drilling and cutting resistance, large torque, and low drilling efficiency during use.

SUMMARY OF THE INVENTION

The technical problem to be solved by the present disclosure is to provide a multiple ridge diamond compact for a drill bit with improved drilling performance, strong impact resistance and a capability of prolonging the service life of the drill bit in view of the above-mentioned shortcomings of the prior art.

The present disclosure provides a multiple ridge diamond compact for a drill bit, comprising a cemented carbide substrate and a diamond composite layer, wherein an end surface of the diamond composite layer is provided with at least two ridges angled relative to each other, and converging ends of two adjacent ridges extend to an edge of the diamond composite layer so as to form a concave cutting edge portion at the edge.

In some embodiments, the edge of the diamond composite layer is chamfered, so that a tapered surface is formed at the edge of the diamond composite layer, and the tapered surface and the converging ends of the two adjacent ridges constitute the cutting edge portion.

In some embodiments, the ridges extend radially.

In some embodiments, there are at least three ridges, and one of the ridges is arranged along the radial direction of the diamond composite layer.

In some embodiments, the ridges constitute a polygon.

In some embodiments, there are at least two groups of ridges, each group of ridges is composed of at least two ridges angled relative to each other, and adjacent expanding ends of adjacent groups of ridges intersect in pairs within the end surface of the diamond composite layer.

In some embodiments, the groups of ridges are evenly arranged along the circumference of the diamond composite layer, and the intersection of the expanding ends of the ridges of the adjacent groups is located on the middle area of the end surface of the diamond composite layer.

In some embodiments, each ridge is formed by the intersection of two inclined surfaces, and a groove is disposed between adjacent inclined surfaces located between two adjacent ridges.

In some embodiments, the expanding ends of the ridges are higher than the converging ends.

In some embodiments, the inclined angle between the ridges and the bottom plane of the cemented carbide ranges from 0 to 20 degrees.

In some embodiments, the inclined angle is 0 degrees or 15 degrees.

In some embodiments, the inclined angle between two adjacent ridges ranges from 10 degrees to 90 degrees.

In some embodiments, the shape of the ridges is one of a line, a plane, a cambered surface, and a gradual curved surface.

In some embodiments, the ridges are parts of a conical surface and the conical ridges are tapered from the expanding end toward the converging end.

In some embodiments, the width L of the cutting edge portion ranges from 1 mm to 4 mm.

In some embodiments, the width L of the cutting edge portion is 1.5 mm or 2 mm.

In some embodiments, the radial cross section of the diamond compact is circular or elliptical.

The present disclosure further provides a drill bit comprising the above-mentioned multiple ridge diamond compact.

The present disclosure would obtain at least one of the following beneficial effects:

The plurality of ridges angled relative to each other are set as a cutting surface group to simultaneously cut a formation, the formation is first pre-crushed by means of the ridges angled relative to each other, the ridges first enter the formation from sharp surfaces (the converging ends of the ridges), a crushing pit in the direction of the ridges is further enlarged, and then the formation is further extruded and crushed by inclined surfaces on two sides of the group of ridges, such that the cutting surfaces thereof have a plowing effect, thus improving the crushing and drilling performance, reducing the drilling cutting resistance, and further increasing the ROP-rate of penetration of the diamond drill bit.

The cutting surface group composed of the ridge group and the lateral inclined surfaces also has impact resistance, which would guide the downhole cuttings to discharge, further increase the ROP of the diamond bit, and further enhance the impact resistance of the compact.

There are a plurality of cutting edge parts, and after one cutting edge part is worn, it could be rotated to another unworn cutting edge part for continued use, thereby reducing the use cost of the drill.

DETAILED DESCRIPTION OF THE EMBODIMENTS

The present disclosure will be further described below with reference to the accompanying drawings.

First Embodiment

Figure 1:
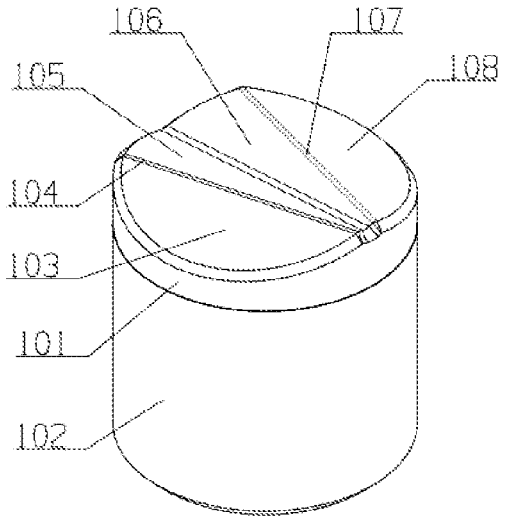
FIG. 1 is a perspective view of a first embodiment.
Figure 2:
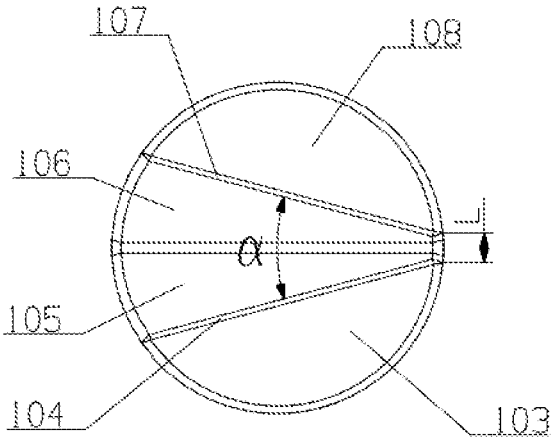
FIG. 2 is a top view of the first embodiment.

As shown in FIG. 1 and FIG. 2, the multiple ridge diamond compact for a drill bit comprises a columnar diamond composite layer 101 and a columnar cemented carbide substrate 102. The end surface of the diamond composite layer 101 is provided with first and second ridges 104 and 107 which are angled relative to each other; the converging ends of the first and second ridges 104 and 107 extend to the edge of the diamond composite layer, and the expanding ends of the first ridge 104 and the second ridge 107 extend to the edge of the diamond composite layer to form a concave cutting edge portion, the distance between the converging ends of the first ridge 104 and the second ridge 107 is less than the distance between the expanding ends of the first ridge 104 and the second ridge 107. There is a chamfer at the circumferential edge of the diamond composite layer 101, so that a tapered surface is formed at the circumferential edge of the diamond composite layer 101. The intersection of the tapered surface and the converging ends of the first and second ridges 104 and 107 constitutes a groove-shaped cutting edge portion. The first ridge 104 is formed by the intersection of a first inclined surface 103 and a second inclined surface 105, the second ridge 107 is formed by the intersection of a third inclined surface 106 and a fourth inclined surface 108, and a groove is formed between adjacent second inclined surface 105 and third inclined surface 106.

In some embodiments, the arc radius of the first ridge 104 and the second ridge 107 is 0.5 mm, and the inclined angles between the first ridge 104 and the bottom plane of the cemented carbide substrate 102 and between the second ridge 107 and the bottom plane of the cemented carbide substrate 102 are 0 degree, and the inclined angles between the first inclined surface 103 and the bottom plane of the cemented carbide substrate 102 and between the fourth inclined surface 108 and the bottom plane of the cemented carbide substrate 102 are 15 degrees. The inclined angle $\alpha$ between the first and second ridges 104 and 107 is 30 degrees, and the width L of the cutting edge portion between the converging ends of the first and second ridges 104 and 107 is 2 mm. The radial cross section of the multiple ridge diamond compact is circular.

In some embodiments, the shape of the ridges is one of a line, a plane, a cambered surface, and a gradual curved surface. The gradual curved surface is a part of a conical surface, and each conical ridge tapers from the expanding end toward the converging end.

In some embodiments, the diamond layer and the cemented carbide substrate are sintered under an ultra-high pressure and high temperature condition, and the bonding surface between the cemented carbide substrate and the diamond composite layer is a flat surface, a concave-convex surface or a grooved surface. Then the end surface of the diamond layer is processed into a desired shape.

Second Embodiment

Figure 3:
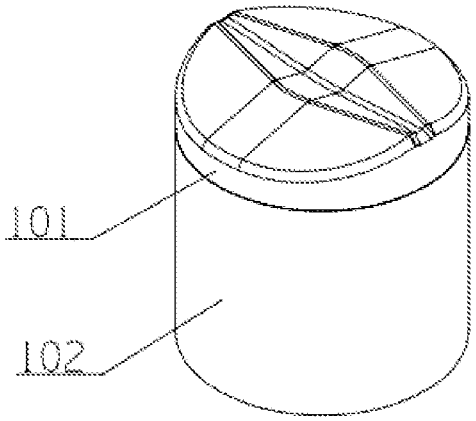
FIG. 3 is a perspective view of a second embodiment.

As shown in FIG. 3, the difference between the second embodiment and the first embodiment lies in: the expanding ends of the ridges intersect at the middle of the end surface of the diamond composite layer through a transition surface. In addition, this embodiment has two groups of symmetrical ridges. Each group of ridges is composed of two ridges angled relative to each other. The two expanding ends of one group of ridges respectively intersect with the two expanding ends of the other group of raised ridges, and the connected ridges intersect through the transition surface. The converging ends of the two groups of ridges respectively intersect with the edge of the diamond composite layer to form two cutting edge portions, and the two cutting edge portions are arranged symmetrically at an angle of 180°.

Third Embodiment

Figure 4:
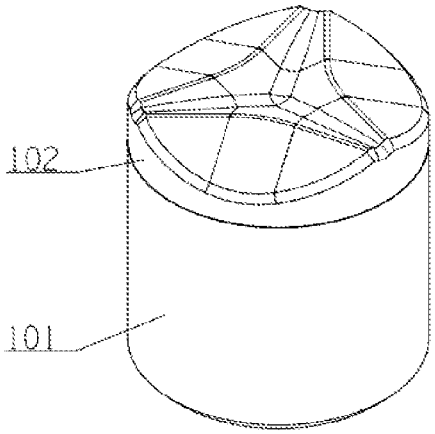
FIG. 4 is a perspective view of a third embodiment.

As shown in FIG. 4, the difference between the third embodiment and second embodiment lies in: three ridges are arranged on the end surface of the diamond composite layer, and both ends of each of the three ridges extend to the edge of the diamond composite layer, a groove-shaped cutting edge portion is formed between two adjacent ends of the two adjacent ridges, the ends of the three ridges form three cutting edge portions, and the three cutting edge portions are evenly arranged circumferentially along the edge of the diamond composite layer.

Fourth Embodiment

Figure 5:
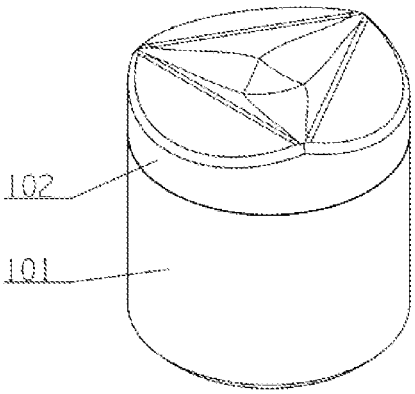
FIG. 5 is a perspective view of a fourth embodiment.

As shown in FIG. 5, the difference between the fourth embodiment and the first embodiment lies in: there are three ridges, and the converging ends of two adjacent ridges extend to the edge of the diamond composite layer to form equilateral triangle ridges. The angle between the two adjacent ridges is 60 degrees, which forms three groove-shaped cutting edge portions evenly arranged in the circumferential direction. The number of ridges may be greater than three, so that the ridges form a polygonal shape, such as a square, and the angle between two adjacent ridges is 90 degrees.

In some embodiments, the width L of the cutting edge portions is 1.5 mm.

Fifth Embodiment

Figure 6:
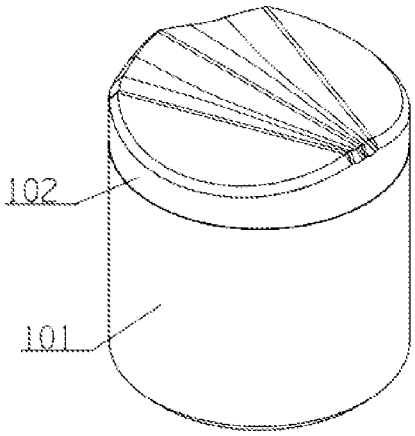
FIG. 6 is a perspective view of a fifth embodiment.

As shown in FIG. 6, the difference between the fifth embodiment and the first embodiment lies in: the end surface of the diamond composite layer is provided with three ridges which extend radially, the middle ridge is in the diameter direction of the diamond composite layer, and the inclined angle between two adjacent ridges is 10 degrees or 15 degrees. There is a angle between the ridges and the bottom plane of the cemented carbide substrate, and the expanding ends of the ridges are higher than the converging ends. The number of ridges may also be greater than three.

In some embodiments, the angle between the ridges and the bottom plane of the cemented carbide is 15 degrees.

Sixth Embodiment

Figure 7:
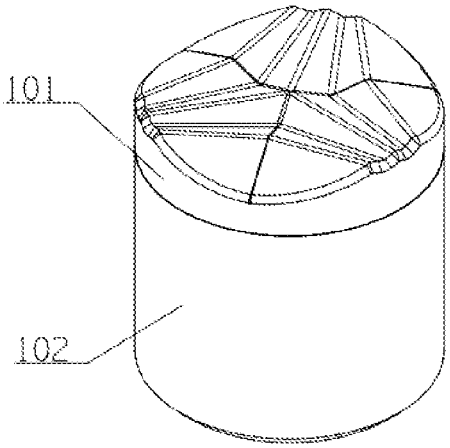
FIG. 7 is a perspective view of a sixth embodiment.

As shown in FIG. 7, the difference between the sixth embodiment and the third embodiment lies in: at least two groups of ridges are disposed on the end surface of the diamond composite layer, and each group of ridges includes three ridges similar to that in third embodiment. Another group of ridges is further included, the another group of ridges includes three ridges, one ends of the three ridges converges at the center of the end surface of the diamond composite layer, and the other ends of the three ridges extend to the edge of the end surface of the diamond composite layer. In some embodiments, the inclined angle between two adjacent ridges in the radial direction is 15 degrees.

The present disclosure further provides a drill bit comprising the above-mentioned multiple ridge diamond compact.

The above-combined embodiments give a detailed description of the embodiments of the present disclosure, but the present disclosure is not limited to the described embodiments. For those skilled in the art, various changes, modifications, equivalent substitutions and modifications to these embodiments without departing from the principle and essential spirit of the present disclosure still fall within the protection scope of the present disclosure.

The invention claimed is:

1. A multiple ridge diamond compact for a drill bit, comprising a cemented carbide substrate (102) and a diamond composite layer (101), wherein:

a top face of the diamond composite layer is provided with at least two ridges angled relative to each other;

each of the at least two ridges comprise a converging end and an expanding end;

converging ends of two adjacent ridges extends to a circumferential edge of the diamond composite layer to form a concave cutting edge portion on the circumferential edge;

each of the at least two ridges are formed by two inclined surfaces, wherein the two inclined surfaces are inclined relative to a bottom plane of the cemented carbide substrate;

a groove is disposed between adjacent inclined surfaces of two adjacent ridges of the at least two ridges;

a distance between the converging end of the two adjacent ridges is less than a distance between the expanding end of the two adjacent ridges; and an expanding end of the at least two ridges extend to the circumferential edge of the diamond composite layer.

2. The multiple ridge diamond compact for a drill bit according to claim 1, wherein the circumferential edge of the diamond composite layer (101) is chamfered, so that a tapered surface is formed at the circumferential edge of the diamond composite layer (101), and the tapered surface and the converging end of each of the two adjacent ridges constitute the concave cutting edge portion.

3. The multiple ridge diamond compact for a drill bit according to claim 1, wherein the at least two ridges extend radially.

4. The multiple ridge diamond compact for a drill bit according to claim 3, wherein there are at least three ridges, and one of the least three ridges is arranged along the radial direction of the diamond composite layer (101).

5. The multiple ridge diamond compact for a drill bit according to claim 1, wherein the at least two ridges comprise three or more ridges, constituting a polygon.

6. The multiple ridge diamond compact for a drill bit according to claim 3, wherein the expanding end of each of the ridges are higher than the converging end of each of the ridges.

7. The multiple ridge diamond compact for a drill bit according to claim 1, wherein the two inclined surfaces are disposed at an angle greater than 0 degrees and less than or equal to 20 degrees relative to the bottom plane of the cemented carbide substrate.

8. The multiple ridge diamond compact for a drill bit according to claim 7, wherein the angle is 15 degrees.

9. The multiple ridge diamond compact for a drill bit according to claim 1, wherein an angle between the two adjacent ridges ranges from 10 degrees to 90 degrees.

10. The multiple ridge diamond compact for a drill bit according to claim 1, wherein the shape of the ridges is one of a line, a plane, a cambered surface, and a gradual curved surface.

11. The multiple ridge diamond compact for a drill bit according to claim 1, wherein each of the at least two ridges comprise a conical shape, wherein each of the at least two ridges are tapered from the expanding end toward the converging end.

12. The multiple ridge diamond compact for a drill bit according to claim 1, wherein the width L of the cutting edge portion is in a range of 1 mm to 4 mm.

13. The multiple ridge diamond compact for a drill bit according to claim 12, wherein the width L of the cutting edge portion is 1.5 mm or 2 mm.

14. The multiple ridge diamond compact for a drill bit according to claim 1, wherein the radial cross section of the diamond compact is circular or elliptical.

15. A drill bit, comprising the multiple ridge diamond compact for a drill bit according to claim 1.

16. A multiple ridge diamond compact for a drill bit, comprising a cemented carbide substrate and a diamond composite layer, wherein:

a top face of the diamond composite layer is provided with at least two groups of ridges, each group of ridges comprises at least two ridges angled relative to each other;

each of the at least two ridges of the groups of ridges include an expanding end and a converging end, wherein two adjacent converging ends in each of the groups extend to a circumferential edge of the diamond composite layer to form a concave cutting edge portion on the circumferential edge, wherein adjacent expanding ends of adjacent groups of ridges intersect in pairs on the top face of the diamond composite layer, wherein the intersection of each of the adjacent expanding ends of adjacent groups of ridges is located in a middle area of the top face of the diamond composite layer; and a groove is disposed between adjacent groups of ridges.

17. The multiple ridge diamond compact for a drill bit according to claim 16, wherein the at least two groups of ridges are evenly arranged along the circumference of the diamond composite layer.

* * * * *